United States Patent [19]

Menjo et al.

[11] Patent Number: 4,883,019

[45] Date of Patent: Nov. 28, 1989

[54] IMAGE FORMING APPARATUS HAVING DEVELOPER CONTENT DETECTOR

[75] Inventors: Takeshi Menjo, Tokyo; Masahiro Inoue, Yokohama; Koji Amemiya, Tokyo, all of Japan

[73] Assignee: Canon Kabushiki Kaisha, Tokyo, Japan

[21] Appl. No.: 145,815

[22] Filed: Jan. 19, 1988

[30] Foreign Application Priority Data

| | | | |
|---|---|---|---|
| Jan. 19, 1987 | [JP] | Japan | 62-009432 |
| Jan. 19, 1987 | [JP] | Japan | 62-009433 |
| Jan. 19, 1987 | [JP] | Japan | 62-009435 |
| Jan. 19, 1987 | [JP] | Japan | 62-009436 |

[51] Int. Cl.[4] ..... G03G 15/08; B05C 11/00

[52] U.S. Cl. ..... 118/691; 118/658; 355/246

[58] Field of Search ..... 118/688, 689, 690, 691, 118/657, 658; 355/3 DD, 14 D, 246

[56] References Cited

U.S. PATENT DOCUMENTS

| | | | |
|---|---|---|---|
| 3,791,744 | 2/1974 | Erny et al. | 118/690 X |
| 4,026,643 | 5/1977 | Bergman | 118/689 X |
| 4,141,645 | 2/1979 | Reid et al. | 355/3 DD |
| 4,222,497 | 9/1980 | Lloyd et al. | 118/689 X |
| 4,265,997 | 5/1981 | Extra et al. | 118/657 X |
| 4,313,671 | 2/1982 | Kuru | 118/688 X |
| 4,372,672 | 2/1983 | Pries | 118/688 X |
| 4,377,338 | 3/1983 | Ernst | 118/688 X |
| 4,462,680 | 7/1984 | Ikeda | 118/691 X |
| 4,550,998 | 11/1985 | Nishikawa | 118/691 X |
| 4,607,944 | 8/1986 | Rushing | 118/688 X |
| 4,646,679 | 3/1987 | Ohno et al. | 118/645 X |

FOREIGN PATENT DOCUMENTS

| | | | |
|---|---|---|---|
| 0190973 | 11/1982 | Japan | 355/14 D |

*Primary Examiner*—Shrive Beck
*Assistant Examiner*—Alain Bashore
*Attorney, Agent, or Firm*—Fitzpatrick, Cella, Harper & Scinto

[57] ABSTRACT

An image forming apparatus including an image bearing member, a developing device for developing a latent image formed on the image bearing member and including a developer carrying member for carrying the developer toward the image bearing member, a toner content detecting device including a reflecting member for receiving light and reflecting a quantity of light corresponding to a reference toner content, a light emitting element and a light receiving element for producing an electric signal in accordance with a quantity of light applied to and received from the reflecting member, and a toner content control device for controlling toner supply to the developing device in accordance with a signal produced by the toner content detecting device. The toner content control device includes a device for storing a ratio of a reference toner content signal to a reference reflection density signal. A toner supply control device is provided for producing a ratio signal representative of a ratio of a toner content signal from the light receiving element to a reflection density signal from the light receiving element, for comparing the ratio signals, and for controlling toner supply to the developing device on the basis of a result of the comparison.

17 Claims, 9 Drawing Sheets

IMAGE FORMING APPARATUS HAVING DEVELOPER CONTENT DETECTOR

FIELD OF THE INVENTION AND RELATED ART

The present invention relates generally to an image forming apparatus, more particularly, to an image forming apparatus wherein an electrostatic latent image is formed on an image bearing member through an electrophotographic process or an electrostatic recording process, and the electrostatic latent image is visualized by a two component developer containing toner and carrier particles.

As is known, in an image forming apparatus wherein an electrostatic latent image is formed on an image bearing member such as a photosensitive drum through an electrophotographic process or electrostatic recording process, and wherein the electrostatic latent image thus formed is visualized with a two component developer, a developer content or toner content indicative of a mixture ratio of the toner and carrier constituting the two component developer is controlled, and the control is deemed very important in order to stabilize the quality of the copy image and to improve the image quality. Therefore, for the purpose of the stabilization of the quality of the image and the improvement of the image quality, a system has been proposed wherein the toner content of the two component developer in the developing device disposed in the neighborhood of the outer periphery of the photosensitive drum is correctly detected, in response to which an amount of toner supply into the developing device is precisely controlled to maintain the toner content in the developing device at a substantially constant level Referring to FIG. 3, there is shown a part of such a system, that is, the developer content detecting device. As will be understood from FIG. 3, the toner content detecting device is disposed within the developing device, above a developing sleeve 2 and outside the developing action performing area, that is, an end of the developing sleeve 2, for example. The toner content detecting device 1 includes a light source 3, a detecting window 4 which opens to the optical axis of the illumination light from the light source 3 and allows the illumination light to pass therethrough to the outer periphery of the developing sleeve 2, a light receiving element 5 for receiving the light reflected by the developer on the outer periphery of the developing sleeve 2 and directed through the window 4 thereto and a reference reflection density pattern 6 disposed between the detection window 4 and the light source 3 and the light receiving element 5. The detection window 4 is covered with a transparent glass. The reference reflection density pattern 6 is movable by an unshown solenoid and an unshown spring about a pin 7 in a direction of an arrow X in FIG. 2 between a position covering the detection window 4 and a position not covering it. The light receiving element 5 sequentially or alternately detects the light reflected by the developer and the light reflected by the reference reflection density pattern 6 when it covers the detection window 4. An electric signal is produced on the basis of the output of the light receiving element 5, and the electric signal is high when the toner content detected by the light receiving element 5 is high and becomes low when the toner content is low. A control system receives the electric signal. It also receives an electric signal as a light quantity signal of the detection optical system such as the light source 3 when the reference reflection density pattern 6 covers the detection window 4 by which the light receiving element 5 receives the light reflected by the reference reflection density pattern 6. The difference between the signals is determined and is discriminated as a detected toner density, on the basis of which the discrimination is made as to whether or not the toner supply is necessary.

This conventional system is disclosed in, for example, U.S. Pat. No. 4,550,998, Japanese Utility Model Application Publication No. 22361/1985 and Japanese Laid-Open Utility Model Application No. 61445/1981. In the above described system, however, when the illumination provided by the light source 3 decreases with time of use, the toner content detecting device produces a signal indicative of lower toner content even if the toner content in the developing device is maintained at the proper level. In response to this, the control system supplies the toner into the developing device with the result that the toner content of the developing device increases too much. As a result, a high quality copy image without foggy background and with good color can not be provided.

Particularly, in the case of a color image forming apparatus which is recently becoming widely used, the toner contents in the respective color developing devices are greatly influential to the image quality, and therefore, the toner content control for each of the developing devices has to be correctly executed, and an attention should be paid to the relation between the developing devices.

SUMMARY OF THE INVENTION

Accordingly, it is a principal object of the present invention to provide an image forming apparatus by which even if a light source of a toner content detecting device is deteriorated with time of use to provide a lower illumination, the toner content control is not obstructed so that a correct control can be maintained.

It is another object of the present invention to provide an image forming apparatus provided with an automatic toner content control system by which the toner content control can be stably performed for all color developers without variation in the accuracy of the toner content control depending on the colors of the developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
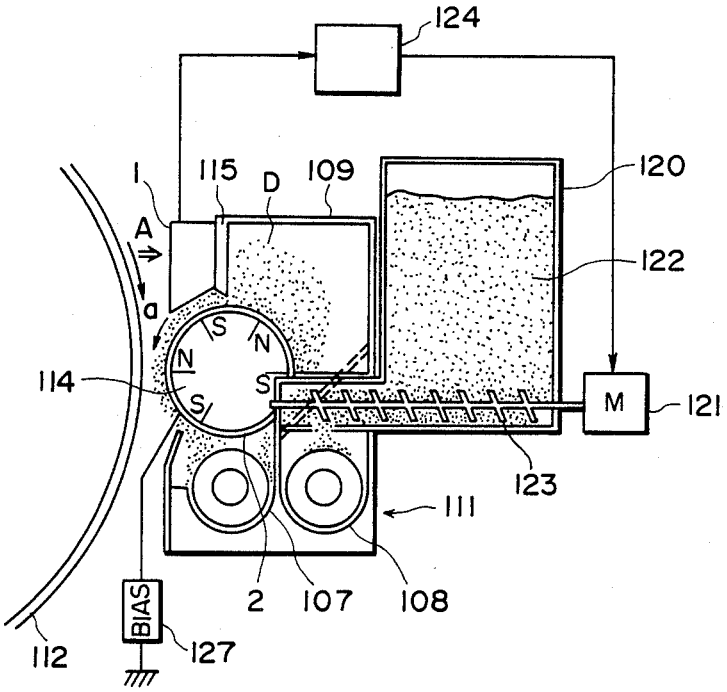
FIG. 2 is a longitudinal sectional view of a part of an image forming apparatus according to an embodiment of the present invention, particularly the part of the developing device and the photosensitive drum.

Referring to FIG. 2, there is shown an image forming apparatus according to an embodiment of the present invention. The exemplary image forming apparatus is a Carlson type electrophotographic apparatus. The general structures are well known, and therefore, FIG. 2 shows in detail a photosensitive drum functioning as an image bearing member and developing means disposed adjacent an outer periphery of the photosensitive drum, because they are particularly related to the present invention. For this reason, a known primary charger in the Carlson process or an image exposure means such as a laser beam scanner, or cleaning means are omitted to this FIG.

In FIG. 2, the image bearing member, i.e., the photosensitive drum 112 is journaled for rotation in the direction indicated by an arrow a (clockwise direction in FIG. 2). Adjacent an outer periphery of the photosensitive drum 112, a developing device 111 is disposed. The photosensitive drum 112 has a photosensitive material, such as OPC (Organic Photoconductor) or the like which is known. On the photosensitive drum 112, an electrostatic latent image is formed using known charging means and image forming means. The developing device 111 includes a developing portion 109 disposed closely to an outer periphery of the photosensitive drum 112 and a hopper 120 communicating with the developing portion 109 and disposed adjacent to the developing portion 109. The developing portion 109 includes a developing sleeve 2, a regulating blade 115, a developer conveying and stirring means 108 and a developer conveying and stirring means 107. The developing sleeve 2 is disposed in an opening formed opposed to the outer periphery of the photosensitive drum 112 and is rotatable in a direction indicated by an arrow a in FIG. 2 (counterclockwise direction). The developing sleeve 2 functions as a developer carrying member. The regulating blade 115 is mounted above the opening and has a free end directed toward the outer periphery of the developing sleeve 2. The developer conveying and stirring means 108 is rotatably mounted at such a side of a bottom of the developing portion 109 as communicates with the hopper 120. The developer conveying and stirring means 107 is rotatable and is disposed parallel to the above described developer conveying stirring means 108 adjacent the bottom of the developing portion 109 and at substantially right below the developing sleeve 2. In the developing sleeve 2, there is a magnet roller 114 having a smaller diameter than the inside diameter of the developing sleeve 2. The magnet roller 114 has n-poles and s-poles disposed substantially equidistantly and alternately around circumference thereof. The magnet roller 114 is coaxial with the developing sleeve 2, but it is fixed to the frame of an apparatus. The developing sleeve 2 is supplied with a developing bias voltage from a developing bias applying source 127. The developing sleeve 2 attracts the two component developer D in the developing portion 109 onto the outer periphery thereof by the developing bias voltage applied thereto from the bias source 127. With the rotation of the developing sleeve 2, the developer D is carried toward the photosensitive drum 112. The regulating blade 115 limits an amount of the two component developer D discharged toward the photosensitive drum by the rotation of the developing sleeve 2, below a predetermined amount, and it confines the developer D not allowed to discharge in the developing portion 109. The developer conveying and stirring means 108, when operated, stirs the toner 122 supplied from the hopper 120 through the communicating portion and the carrier component present in the developing portion 109 to establish a proper mixed state and also convey the mixture to the developing sleeve 2 side. The developer conveying and stirring means 107, when operates, stirs the carrier component and the toner 122 of the two component developer D stagnating in the developing portion 109 to establish a proper mixed state and supplies the mixture to the developing sleeve 2, similarly to the developer conveying and stirring means 108.

According to an embodiment of the present invention, a toner content detecting device 1 is mounted to such a side of the regulating blade 115 as is opposed to the outer periphery of the photosensitive drum 112 to detect the mixture ratio of the toner 122 and the carrier component constituting the two component developer D in the developing portion 109. The structure of the toner content detecting device 1 is substantially the same as described hereinbefore, and therefore, the detailed description thereof is omitted for the sake of simplicity. Adjacent a bottom of the hopper 120 constituting a developing device 111 together with the developing portion 109, a screw 123 is rotatably mounted. The screw 123 is effective to supply the toner 122 contained in the hopper 120 into the developing portion 109. An end thereof is penetrated through the frame of the hopper 120 and is coupled with a rotational shaft of a motor M 121 outside the hopper 120, whereas the other longitudinal end extends through a communicating portion between the hopper 120 and the developing portion 109 to a frame defining the hopper 120.

The motor M 121 is controlled by a logic level signal produced from a toner content control device 124 which receives a detection signal from the toner content detecting device 1 and executes a predetermined processing operation.

Figure 1:
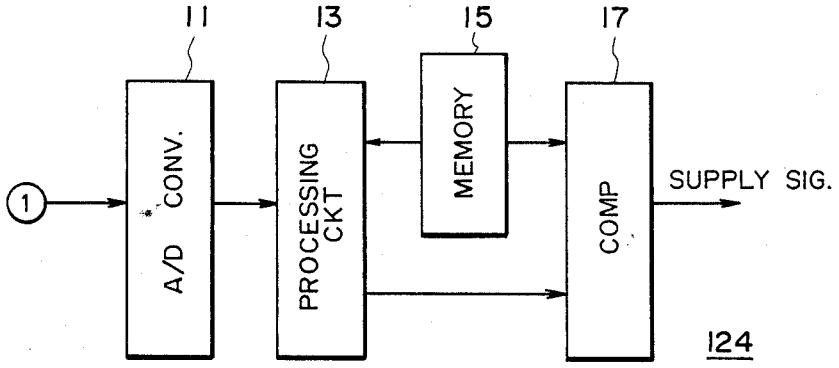
FIG. 1 is a block diagram illustrating a structure of a toner content control device employed in an image forming apparatus according to an embodiment of the present invention.

Referring now to FIG. 1, there is shown a structure of the toner content control device 124 incorporated in an image forming apparatus according to an embodiment of the present invention. The control device includes an A/D converter 11, a processing circuit 13, a memory 15 and an comparison circuit 17. The A/D converter 11 receives an analog voltage signal from the light receiving element 5 and converts it a digital signal. The processing circuit 13 processes in a predetermined manner the digital signal transmitted from the A/D converter 11. The memory 15 stores various data such as data indicative of a reference level of the toner content. The comparison circuit 17 processes and compares the data from the memory 15 and the data from the processing circuit 13 and determines on the basis of the comparison whether or not the toner is to be supplied into the developing device. The A/D converter 11 receives the analog voltage signal produced by the light receiving element 5 when it receives the light reflected by the developer and converts the analog voltage signal to a digital signal Dl. Also, it receives an analog voltage signal produced by the light receiving element 5 when it receives the light reflected by the reference reflection density pattern 6, and it converts the analog voltage signal to a digital signal D2.

In this embodiment, the memory 15 stores data D10 indicative of a reflected light quantity of a standard or reference toner content which is the quantity of the light reflected by the developer having the reference content and data D20 indicative of a light quantity of a reference reflection density pattern which is a quantity of light reflected by the reference reflection density pattern 6. Also, the memory 15 stores data D30 indicating that the toner content of the developer in the developing device is at the reference content, that is, a difference between the data D10 and the data D20.

The processing circuit 13 receives the digital signals Dl and D2 from the A/D converter 11 and calculates a difference D3 = D1−D2, and it deems the difference D3 as the detected toner content signal. Also, the processing circuit 13 reads the reference reflection density pattern quantity data D20 stores in the memory 15, and corrects the difference D3 to obtain a corrected value, D3′ by the following equation:

$$D3' = D3 \times (D20/D2)$$

Further, the processing circuit 13 produces and transmits the corrected data D3′ indicative of the detected toner content to the comparison circuit 17. The comparison circuit 17 compares the corrected value D3′ from the processing circuit 13 and the reference toner content data D30 stored in the memory 15. If the result of comparison is D3′ ≧ D30, the toner content in the developing device is proper or higher, and it does not produce a logic level "1" signal indicative of toner supply instruction. If, however, the result of the comparison is D3′ < D30, it recognizes that the toner content in the developing device is low and outputs the logic level "1" signal to effect the toner supply.

By employing the toner content control device having the structure described above in an image forming apparatus, the following inconveniences with conventional apparatus can be eliminated.

Figure 3:
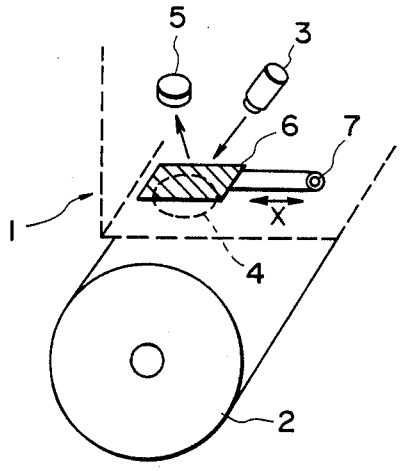
FIG. 3 PRIOR ART
FIG. 3 is a partial perspective view of the developer content detecting apparatus used with a conventional image forming apparatus and also an image forming apparatus according to an embodiment of the present invention.
Figure 4:
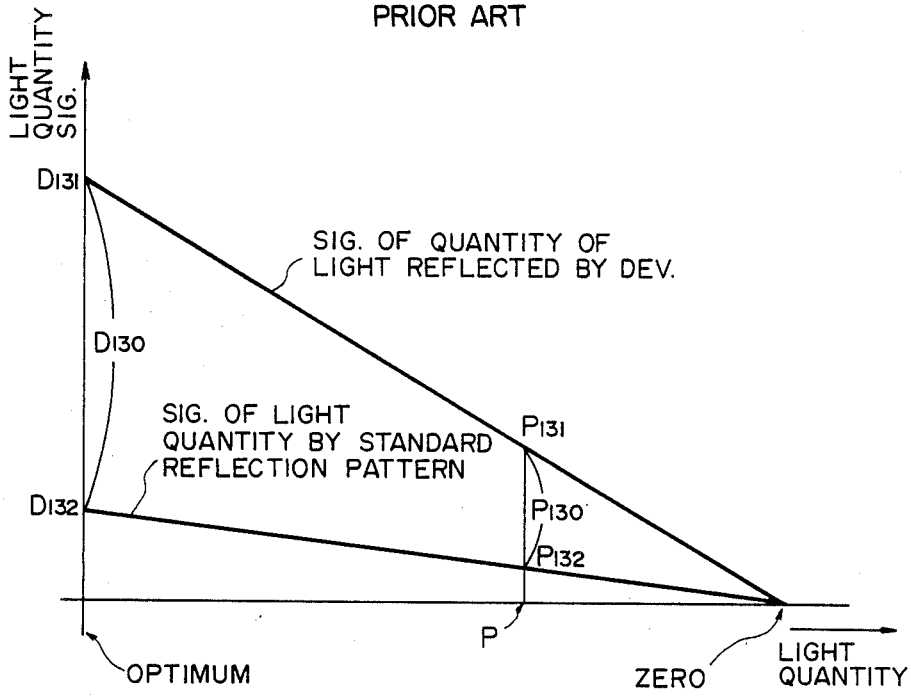
FIG. 4 is a graph showing a reflection density signal detected by a light receiving element of a toner content detecting device, illustrating a change when a detecting optical system is deteriorated with time.

FIG. 4 shows states of signals produced by the light receiving element 5 when the light source 3 or the like of the toner content detecting device 1 shown in FIG. 3 is deteriorated to provide a lower illumination and when the developer content in the developing device is maintained at the reference level, when a conventional toner content control device. In FIG. 4, data 131 indicates the quantity of light reflected by the developer and received by the light receiving element when the light source 3 provides a proper quantity of light without deterioration. Data 132 indicates a reference reflection density pattern quantity of light produced by the light receiving element 5 when the light source 3 is not deteriorated, and therefore, provides a proper illumination. Data 130 is a difference between the data 131 and the data 132. When the light source 3 is deteriorated with use to provide a lower illumination, a signal P131 indicative of the quantity of light reflected by the developer and received by the light receiving element 5 is produced, and a reference reflection density pattern quantity signal P132 is produced by the light receiving element 5. Then, the data P130 indicative of the detected toner content is determined, as understood from FIG. 4, as P131 − P132. Therefore, the difference P130 is compared with the reference toner content level D130, in response to which the discrimination is made as to whether or not the toner is to be supplied into the developing device. However, the comparison between the toner content detection data D130 when the amount of light produced by the light source 3 is proper and the toner content detection data P130 when the amount of light produced by the light source 3 is reduced, results in D130 > P130. If, therefore, the data P130 is compared with the reference toner content data D130, the discrimination results in that the toner content is lowered even if the toner content in the developing device is actually the same as or higher than the reference toner content density level. Therefore, the toner is erroneously supplied into the developing device, with the result that the amount of the toner in the developing device is too much.

In the embodiment of the present invention, the data P130 is corrected by the above described equation by the processing circuit 13. The equation is in this case:

$$P130 \times (D132/P132) = P130'$$

The corrected data P130′ is compared with the reference toner density level D130 by the comparison circuit 17 to determine whether or not the toner is to be supplied.

Using the above described toner content control device, even if lower illumination or reduced light quantity occurs due to use of the apparatus in the detection optical system including the light source 3 of the toner content detecting device 1, it can be avoided that the toner content in the developing device is extremely increased.

In the foregoing description, the toner content detecting device has the structure as shown in FIG. 3 to detect the toner content in the developing device. However, the present invention is not limited to this. For example, the present invention is applicable even if, for example, the reference reflection density pattern signal is obtained in another manner, or arrangement of the detection optical system is changed. Also, the present invention is applicable in the structure where an optical system such as an optical fiber is inserted between the light source 3 and the detection window 4 and between the detection window 4 and the light receiving element 5, and in this case, the present invention is applicable to correct the detection signal when the optical system is contaminated by toner or dust resulting in lower quantity of light. Also, the present invention is effectively applicable to an apparatus such as a color image forming apparatus wherein a change in the toner content is influential to the reproduction of the color.

Another embodiment of the present invention will be described, wherein a data ratio is taken in place of the data difference in the foregoing embodiment. The structures shown in FIGS. 1 and 2 are employed in this embodiment, but the circuits 13 and 17 are modified as follows.

In this embodiment, the memory 15 stores data D10 indicative of a reflected light quantity of a standard toner content which is the quantity of the light reflected by the developer having the reference content and data D20 indicative of a light quantity of a reference reflection density pattern which is a quantity of light reflected by the reference reflection density pattern 6. Also, the memory 15 stores data D33' indicating that the toner content of the developer in the developing device is at the reference content, that is, a ratio between the data D10 and the data D20.

The processing circuit 13 receives the digital signals Dl and D2 from the A/D converter 11 and calculates the ratio D33 = D1/D2, and it deems the difference D3 as the detected toner content signal. Further, the processing circuit 13 produces and transmits the corrected data D33 indicative of the detected toner content to the comparison circuit 17. The comparison circuit 17 compares the value D3 from the processing circuit 13 and the reference toner content data D'33 stored in the memory 15. If the result of comparison is D33 ≧ D'33, the toner content in the developing device is proper or higher, and it does not produce a logic level "1" signal indicative of toner supply instruction. If, however, the result of the comparison is D33 ≦ D'33, it recognizes that the toner content in the developing device is low and outputs the logic level "1" signal to effect the toner supply.

By employing the toner content control device having the structure described above in an image forming apparatus, the inconveniences with conventional apparatus described in conjunction with FIG. 4 can be eliminated.

In this embodiment, the division is effected between two signals, the processing circuit 13 preferably has a signal processing capability of 32 bits, not 8 bits signal processing capability.

Figure 6:
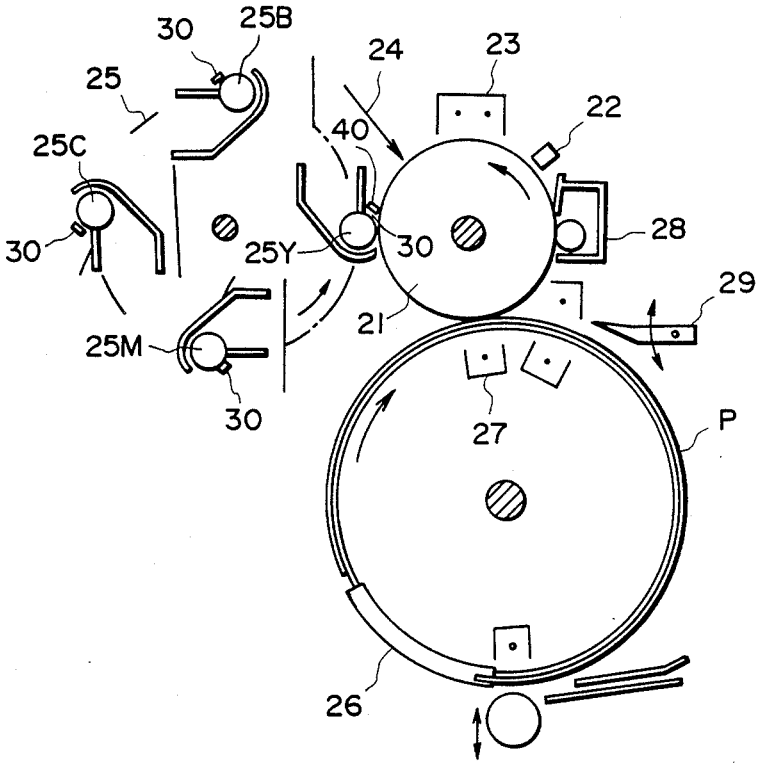
FIG. 6 is a partial longitudinal sectional view illustrating an image forming apparatus according to an embodiment of the present invention.
Figure 7:
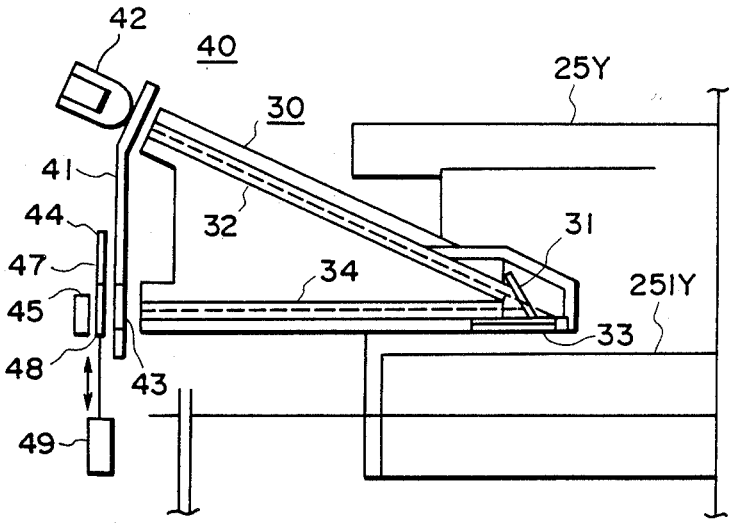
FIG. 7 is a longitudinal sectional view of a toner content detecting device used with a conventional image forming apparatus and with an image forming apparatus according to an embodiment of the present invention.

Referring to FIG. 7, an embodiment wherein an automatic toner content control system with a toner content detecting device is incorporated into a color image forming apparatus. Various types of color image forming apparatuses have been developed. The exemplary color image forming apparatus shown in FIG. 6 provided with the toner content detecting device shown in FIG. 7 includes a photosensitive drum functioning as an image bearing member rotatably supported, a rotary developing device, a transfer drum and other various elements around them. The rotary developing device is rotatably mounted in the neighborhood of the photosensitive drum and includes four developing units which contain yellow (Y), magenta (M), cyan (C) and black (B) developers, respectively. The developers are two component developers. The transfer drum is rotatably mounted so as to be in contact with the outer periphery of the photosensitive drum.

The toner content detecting device shown in FIG. 7 generally and mainly consists of four inside detecting units 30 provided for four developing units i.e. yellow developing unit, magenta developing unit, cyan developing unit and black developing unit and of one outside detecting unit 40 which is mounted to a side plate of an image forming apparatus at a position out of contact with the inside detecting units 30. All the inside detecting unit 30 have the same structure, and therefore, the description will be made with respect to the inside unit 30 for the yellow developer 25Y and the external detection unit 40.

The inside detection unit 30, as shown in FIG. 7, a unit supporting member having a longitudinal cross section in the general form of a triangle and having a projection extending to the neighborhood of a developing sleeve 251Y in the developing device 25Y. It further comprises two optical fibers 32 and 34, a reflection mirror 31 and a toner content detecting window 33. The optical fibers 32 and 34 are arranged to form "V" shape along long sides of the unit supporting member. The reflection mirror 31 is disposed adjacent a position of contact between the two optical fibers 32 and 34. The detection window 33 is formed in the unit supporting member adjacent the reflection mirror 31 so as to oppose an external surface of the developing sleeve 251Y.

The outside detecting unit 40 includes a supporting member 41, a light source 42, an opening 43, a light receiving element 45, a color separation filter 44 and a solenoid 49. The supporting member 41 is mounted to the frame of the image forming apparatus so as to be opposed to the inside detection unit 30 of one of the developing units stopped at the developing position. The light source 42 is mounted to such a position as opposes to an end of the optical fiber 32. The opening 43 is formed at a position opposing to an end of the optical fiber 34. The light receiving element 45 is a photodiode in this embodiment and is disposed spaced from the supporting member 41 by a predetermined gap on a longitudinal extension of a line connecting the end of the optical fiber 34 and the opening 43. The color separation filter 44 is substantially vertically movable in the space between the supporting member 41 and the light receiving element 45. The solenoid 49 functions to substantially vertically move the color separation filter 44. The light source 42 emits white light as illuminating light. The optical fiber 32 receives the white light from the light source 42 and transmits it to the reflection mirror 31, which reflects the received light to illuminate the toner content detection window 33. The reflection mirror 31 receives the light incident thereon through the detection window 33 and reflects it to the optical fiber 34. The detection window 33 is covered by a dichroic mirror which reflects spectral energy light A shown in FIG. 3 but transmits spectral energy light B different from the light A. For example, of the white light components, the visible component having a wavelength not more than approximately 700 nm and transmits near infrared component having a wavelength larger than 700 nm. Therefore the detection window 33 transmits the near infrared component of the light which has transmitted through the direction window 33 and reflected by the developer on the developing sleeve 251Y to allow the component to be directly incident on the reflection mirror 31 or the optical fiber 34. The optical fiber 34 receives the infrared component given from the reflection mirror 31 or through the detection window 33 and directs it to the light receiving element 45 through the opening 43 and the color separation filter 44. The optical fiber 34 receives directly or by way of the reflection mirror 31 the spectral energy light A reflected by the surface of the dielectric mirror (not passing therethrough) to direct it to the light receiving element 45 in the same manner as described above. The color separation filter 44 includes a filter member having an enough area to cover the light receiving portion of the light receiving element 45 and a filter member 48 having substantially the same area as the filter member 47, which are integrally formed. The filter member 47 transmits only the visible component having the wavelength not more than 700 nm reflected by the surface of the dichroic mirror so that the visible component is given to the light receiving element 45 as a reference light r. On the other hand, the filter member 48 transmits only the infrared component having passed through the dichroic mirror to allow it to be incident on the light receiving element 45 as a toner content direction light d.

The color separation filter 44 is movable substantially vertically as indicated by an arrow in FIG. 7 by a solenoid 49 and an unshown spring. At an initial state of the developing operation, it displaces the filter member 47 across an axis connecting the light receiving portion of the light receiving element 45 to allow the reference light 4 to be incident on the light receiving element 46. At a terminal stage of the developing operation, the filter 48 is displaced across the axis connecting the light receiving portion of the light receiving element 45 and the opening to allow the toner content detection light d onto the light receiving element 45. The quantity of light of the toner content detection light d increases with the toner content in the developing device and decreases with the decrease of the toner content therein. When the light receiving element 45 receives such light d through the filter 48, it produces as the toner content detection signal an electric signal corresponding to the incident light. When it receives the reference signal corresponding to the quantity of light of the reference light r, which is used as a reference signal for detecting the above described deterioration of the light source 45 and the contamination of the detecting optical system.

Figure 10:
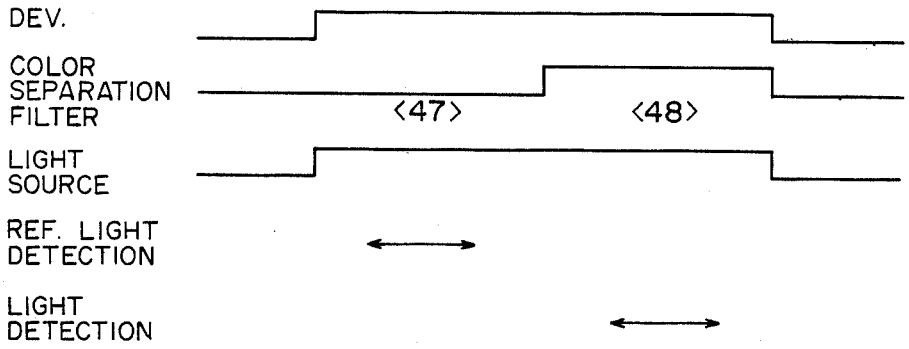
FIG. 10 is a time chart illustrating drive timing of each of various elements including signals produced from the device shown in FIG. 3.

Referring to FIG. 10, the reference signal and the toner content detection signal indicative of the toner content in each of the developing devices are transmitted from the toner content detecting device described above to a control system constituting the automatic toner content control system together with the toner content detecting device in the timing shown in this Figure. When the signals are applied thereto, the signals are amplified to provide predetermined amplitude by an amplifying circuit constituting the control system, and thereafter, they are converted into digital signals by an A/D converter in the control system. A digital electronic circuit control means of the control system obtains a difference between the signals, and the difference is deemed as the toner content. The difference is compared with the toner content reference on level which is stored in the control system for each of the colors. On the basis of the comparison, the toner supply is controlled.

Figure 8:
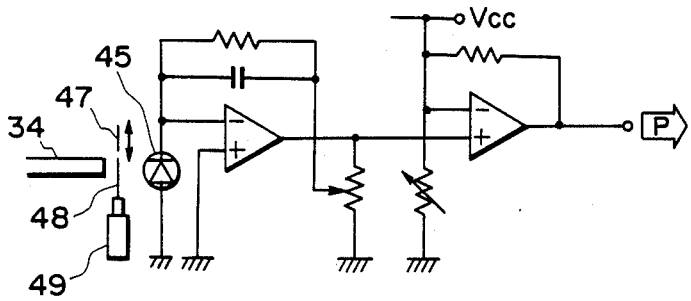
FIG. 8 shows a circuit of a primary amplifier provided in a conventional image forming apparatus and an image forming apparatus according to an embodiment of the present invention.

FIG. 8 shows a circuit of a primary amplifier as an example of the amplifying circuit used for the control system constituting the automatic toner content control system. The primary amplifier, as shown in FIG. 8, includes a first stage circuit and a second stage circuit. The first stage circuit functions as a preamplifier provided with an operational amplifier receiving the signal from the light receiving element 45 at a reversed input terminal. The second stage circuit is a non-reversed amplifying circuit provided with an operational amplifier, which is separate from the first operational amplifier, which receives an output signal from the first stage operational amplifier at a non-reversed input terminal. The primary amplifier produces a signal P.

However, if an attempt is made to control the toner content in the developing device using the above described automatic toner content control system, the following problems arise. When the toner contents of the respective developers having different colors are detected, the refractive indexes of the respective developers are different with respect to the near infrared light having the wavelength of not less than approximately 700 nm (the toner content detecting light d). Therefore, the toner content detecting signal levels for the reference toner contents for the respective developers are greatly different. In addition, percentages of loss of light resulting from manufacturing errors and tolerances when the optical fibers 32 and 34, the reflecting mirror 31 or the like in the detecting unit 30 contained in the respective developers are different for the respective inside detecting units 30. For those reasons, even if the illumination light having the same quantity of light is applied from the light source 42 to the inside detecting unit 30, the amounts of light incident on the light receiving element 45 through the respective inside detection units 30 differ. Therefore, a large variation results in the signals representing the reference toner content detection level for the respective colors. Accordingly, the control accuracies of the toner supply to the respective developing devices are not uniform, with the result that the control range of the toner content is different for each of the colors.

Figure 14:
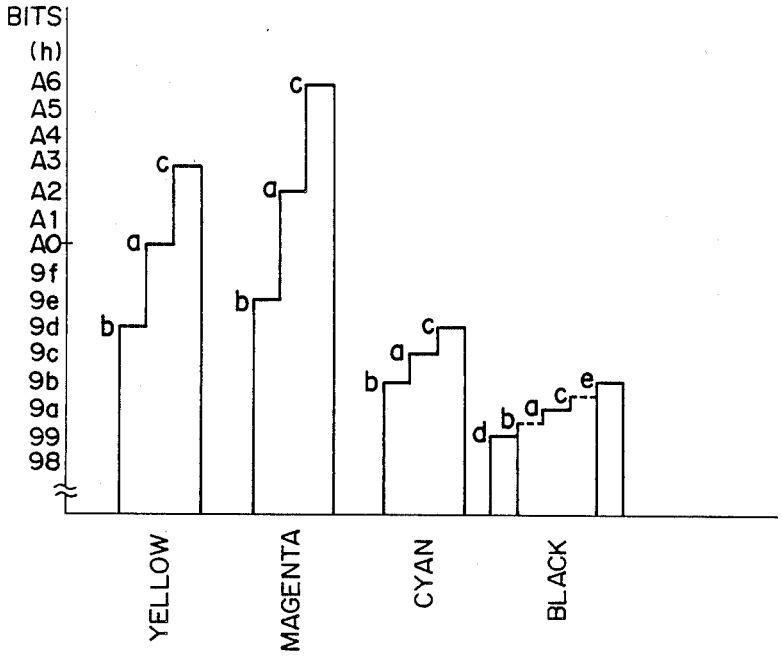
FIG. 14 is a graph illustrating reference toner content signals for the respective color developers processed by the control system shown in FIG. 11.

This problem will become clearer if FIG. 14 is referred to. A 5V signal which is the maximum output signal of the analog voltage signal outputted from the light receiving element 45 is converted by the A/D converter to FFh bit digital signal, and thereafter, a digital operational and processing means such as a microcomputer produces a difference level between the toner content detection signal and the reference signal representing the toner content. For each of the developers, the reference toner content signal level a, the signal level b representing the reference toner content $-1\%$ and a signal level c representing the reference toner content $+1\%$ are shown in FIG. 14. As will be apparent from the Figure, if the reference toner content signal level a is different, the amount of change of the toner content signals b and c corresponding to ±1% change of the toner content are different. More particularly, when the level a of the reference toner content signal becomes large, the amount of change in the toner content signal b or c corresponding to ±1% change of the toner content becomes large, and vice versa. Particularly in the case of the black developer, the level a of the reference toner content signal is small, the amount of change of the toner content signal b or c corresponding to ±1% of the toner content is so small that it does not amount to 1 bit, with the result that one bit change requires ±2% of the toner content (d and e of FIG. 4). As a result, the toner content control can be effected only in the order of ±2%.

Figure 15:
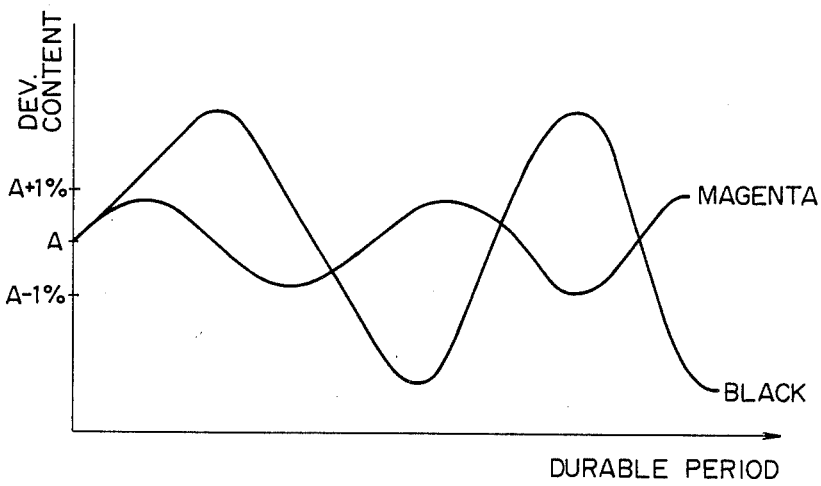
FIG. 15 is a graph showing a change of the toner content for the magenta and black developers with time, when the control system shown in FIG. 11 is used.

Referring to FIG. 15, there is illustrated a relationship between the toner content change of each of the magenta and black developers with time. Since the accuracy of the content control of the black developer is lower than that of the magenta developer, the ratio of content change with respect to the reference toner content A is far large in black developer than in magenta developer.

Figure 9:
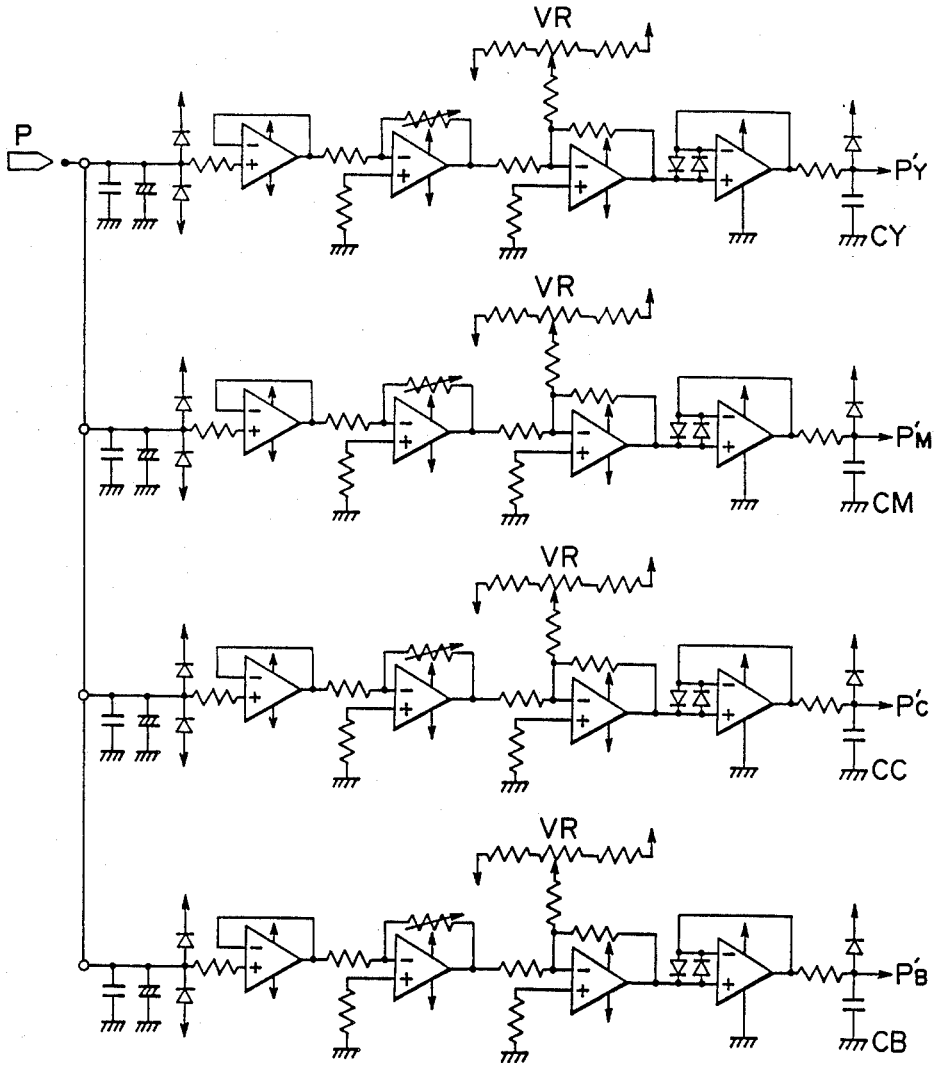
FIG. 9 shows a circuit of a secondary amplifier provided in a conventional image forming apparatus and an image forming apparatus according to an embodiment of the present invention.

The problem has been solved in this embodiment of the present invention by connecting a secondary amplifier shown in FIG. 9 is connected to the rear side of the primary amplifier. The secondary amplifier receives the signal P from the primary amplifier and amplifies it for each of the colors. The secondary amplifier includes four amplifying units CY, CM, CC and CB having the same structure and for receiving signals corresponding to yellow, magenta, cyan and black developers, respectively are connected parallel to the output side of the primary amplifier. Each of the developing units includes four operational amplifier connected in series. More particularly, each of the amplifying units includes a first circuit functioning as a voltage follower, a second circuit for receiving an output signal from the first circuit at a reversed input terminal and provided with an operational amplifier to which a variable resistor VR is connected in a negative feedback circuit, a third circuit for receiving an output signal from said second circuit at a reversed input terminal and provided with an operational amplifier to which a variable resistor VR connected to the terminal and the voltage source is connected, and a fourth circuit for receiving an output from the third circuit and functioning as a voltage follower.

When the toner content detecting device shown in FIG. 7 detects the reference toner content set at the same level for all colors, the amplifying units CY, CM, CC and CB receive through the primary amplifier a signal P2YO corresponding to the toner content detection light d for the yellow developer and a signal P1YO corresponding to the reference light r for the yellow developer, a signal P2MO corresponding to the toner detection light d for the magenta developer and a signal P1MO corresponding to the reference light r for the magenta developer, a signal P2CO corresponding to the toner content detection light d for the cyan developer and a signal P1CO corresponding to the reference light r for the cyan developer and a signal P2BO corresponding to the toner content detection light d for the black developer and a signal P1BO corresponding to the reference light r for the black developer, respectively. By adjusting the variable resistor VR in the second circuit and the variable resistor VR in the third circuit in each of the amplifying units CY, CM, CC and CB, output signals having the same signal level are produced at the output terminals P'Y, P'M, P'C and P'B of the respective amplifying unit when the above signals are inputted to the amplifying units. By setting the variable resistors VR in the manner described above, the output terminal P'Y produces a signal P'2YO corresponding to the toner content detection light for the yellow developer; the output terminal P'M produces a signal P'2MO corresponding to the toner content detection light for the magenta developer; an output terminal P'C produces a signal P'2CO corresponding to the toner content detection light for the cyan developer; and the output terminal P'B produces a signal P'2BO corresponding to the toner content detection light corresponding to the black developer; wherein P'2YO = P'2MO = P'2CO = P'2BO. Similarly, the output terminal P'Y produces a signal P1YO corresponding to the reference light for the yellow developer; the output terminal P'M produces a signal P'1MO corresponding to the reference light for the magenta developer; the output terminal P'C produces a signal P'1CO corresponding to the reference light for the cyan developer; and the output terminal P'B produces a signal P'1BO corresponding to the reference light for the black developer; wherein P'1YO = P'1MO = P'1CO = P'1BO. The output signals from the secondary amplifiers are transmitted to an input interface 53' of the processing and control system of the toner content control device having the structure shown in FIG. 12, and then further inputted into I/0 port 54 from the input interface 53'.

When the above described signals are inputted to the processing and control system of the toner content control device shown in FIG. 12, the processing and control system executes a control for toner supply in the following process. The yellow developing device 25Y containing the yellow developer is taken as an example.

Figure 11:
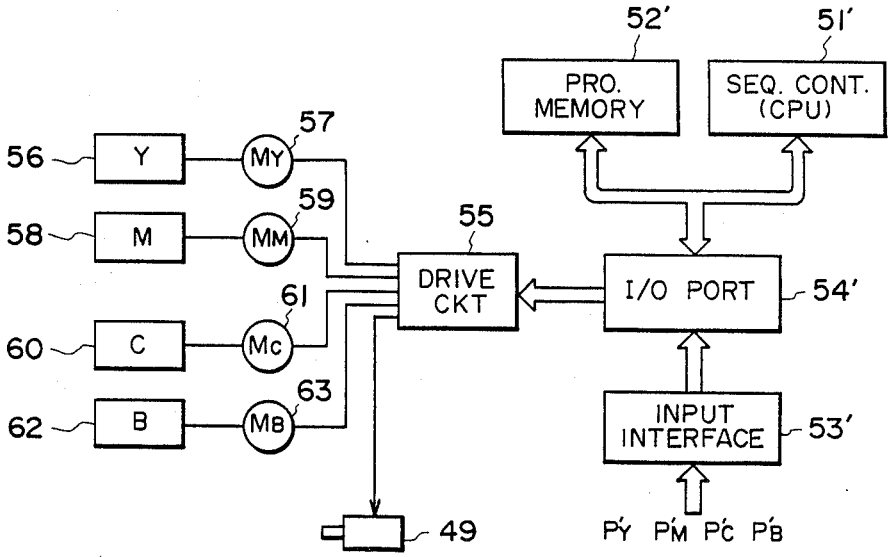
FIG. 11 is a block diagram illustrating a processing and control system of a toner content control device used with an apparatus according to an embodiment of the present invention.

A sequence controller (which will be hereinafter called "CPU") 51' operates in accordance with the sequence shown in FIG. 11 which has been programmed in the program memory 52. When, for example, a signal by the light having passed through the filter 47 which allows only the reference light r to pass is first amplified by the primary and secondary amplifiers, the signal P'1Y after amplification is received and memorized by a predetermined address in the program memory 52' through an input interface 53 comprising an analog/digital converter or the like and through an I/0 port 54'.

Then, the CPU 51' actuate through the I/O port 54' and a driving circuit 55 a filter exchanging plunger 49. In timed relation with this, a signal P'2Y is amplified by the primary and secondary amplifiers on the basis of the detection light d from the filter 48, and the amplified signal P'2Y is memorized at a predetermined address of the program memory 52'. Subsequently, the similar operation is repeated for the respective color developers, i.e., the magenta developer, the cyan developer and the black developer to detect the toner content of each of the developers. The CPU 51 reads selectively signals produced from the output terminals P'Y, P'M, P'C and P'B of the secondary amplifier, in accordance with the sequence stored in the process memory 52', and determines the toner content for each of the developers in the similar process described above. Since, for example, the toner content detection for a reference developer for each color which is set at the same toner content level is effected, the outputs for yellow are P'2YO, P'1YO; the outputs for magenta are P'2MO and P'1MO; the outputs for cyan are P'2CO and P'1CO; and the outputs for black are P'2BO and P'1BO. For each colors differences representing reference toner content signals are obtained by $$P'2YO - P'1YO = D3YO$$

$$P'2MO - P'1MO = D3MO$$

$$P'2CO - P'1CO = D3CO$$

$$P'2BO - P'1BO = D3BO.$$

Then, D3YO = D3MO = D2CO = D3BO is satisfied.

Therefore, there exists no variation in the signal level of the reference toner content signal for each colors. As a result, the accuracies of the toner supply controls for the respective colors are uniform, and the control range of the toner content is also uniform.

Figure 12:
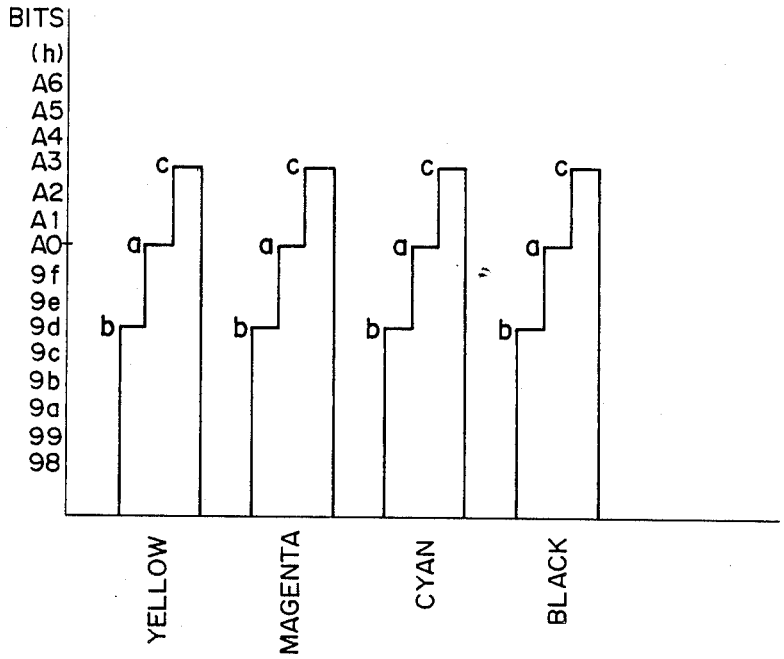
FIG. 12 is a graph showing difference toner content signals for respective color developer processed by a developer content control device provided in an image forming apparatus according to an embodiment of the present invention.
Figure 13:
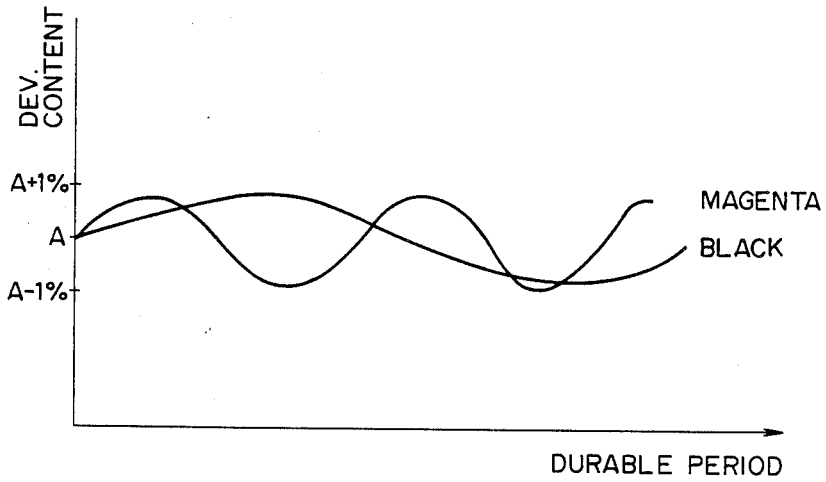
FIG. 13 is a graph showing a change of toner contents for magenta and black developers with time in an image forming apparatus according to an embodiment of the present invention.

This will become more apparent if FIG. 14 and FIG. 12 are compared. FIG. 12 shows the changes in the toner content signals for the respective colors corresponding to ±1% change of the toner content according to this embodiment. As will be apparent from this Figure, the changes are uniform over all colors. Also, if FIGS. 15 and 13 are compared, it becomes apparent that according to this embodiment, the toner supply control is effected with high and uniform accuracy for those developers. The reason why the periods for the magenta developer and the cyan developer are different is that the toner consumptions are different.

In this embodiment, the toner content detecting device uses a near infrared light. However, another type is usable, for example, visible light may be used. Also, the structures for the primary and secondary amplifiers and operational processing and control system may be other than those described above. In addition, the number of colors of the developers are not limited to four, but the present invention is applicable to two colors, three colors and five colors or more. The arrangement of the developing device is not limited to the rotary type described above, but the present invention is applicable to a stationary type developing device. As described in the foregoing, according to this embodiment of the present invention, the variation can be avoided which otherwise exists in the accuracy of the toner content control due to the differences in the colors of the developer to be detected and in the detecting systems for the respective developing devices. Therefore, the toner content control is stabilized for all colors used with the image forming apparatus.

The sequential operation will be further described.

The reference toner content signals D3YO, D3MO, D3CO and D3BO for each color developers wherein D3YO = D3MO = D3CO = D3BO are stored in the program memory 52' as data D30 (D3YO = D3MO = D3CO = D3BO = D3D30). In addition to the data D30, the program memory 52' stores signals (P'1) for the reference light r and the detection light d (P'2), for the respective colors:

Reference light signal for yellow developing device: P'Y1

Reference light signal for magenta developing device: P'M1

Reference light signal for cyan developing device: P'Cl

Reference light signal for black developing device: P'B1

Detection light signal for yellow developing device: P'Y2

Detection light signal for magenta developing device: P'M2

Detection light signal for cyan developing device: P'C2

Detection light signal for black developing device: P'B2

The CPU 51' determines the toner content signals for the respective color developers from the data stored in the program memory 52. More particularly, the yellow, magenta, cyan and black toner content signals DY, DM, DC and DB are obtained by the following equations:

$$DY = P'Y2 - P'Y1$$

$$DM = P'M2 - P'M1$$

$$DC = P'C2 - P'C1$$

$$DB = P'B2 - P'B1$$

Then, the CPU 51 compares the toner content signal of each of the color developers obtained above and the reference toner content signal for each color developers stored in the program memory 52'. Taking an yellow developer as an example, if the result of comparison is DY ≧ D30, the CPU 51' deems that the yellow toner content is proper or high, so that the toner supply into the yellow developing device 25Y is not instructed. If, however, the result of comparison is DY < D30, it is deemed that the toner content is low, and the CPU 51' produces a drive instruction signal to the driving circuit 55, in response to which a hopper driving motor (MY) 57 for the yellow toner hopper 56 is driven, so that the yellow toner is supplied into the developing device 25Y from the hopper 56. Subsequently, the same signal processing and toner supply, if necessary, are executed for each of the magenta developer, cyan developer and black developer. The magenta toner, the cyan toner and the black toner are supplied from a hopper 58 by a driving motor (MM) 59, from a hopper 60 and a driving motor (MC) 61 and from a hopper 62 and a driving motor (MB) 63, respectively.

Even in the automatic toner content control system described above, it is required at the initial operation using a reference content developer that eight variable resistors in the secondary amplifiers have to be manually adjusted so as to provide D3YO = D3MO = D3CO = D3BO. Further, the eight variable resistors VR have to be adjusted so that the reference toner content signals D3YO, D3MO, D3CO and D3BO for four colors are equal to data D30 stored in the program memory 52'. A further embodiment will be described wherein is inconveniences are eliminated.

FIG. 6 is used for explanation of this embodiment. An electrostatic latent image forming part includes a photosensitive drum 21, and cleaning means 28, pre-exposure means 22 and corona charger 23 disposed around the photosensitive drum 21 in the direction of rotation of the photosensitive drum 21 (counterclockwise direction in FIG. 2). A transfer station includes a known transfer drum 26 supported for rotation in the clockwise direction as viewed in FIG. 6 and disposed at such a position that its outer periphery is in contact with the outer periphery of the photosensitive drum 21, known transfer corona discharger 27 disposed inside the transfer drum 26 at such a position that it is opposed to the contact area between the transfer drum 26 and the photosensitive drum 21 and a separation pawl 29 disposed adjacent the outer periphery of the transfer drum 26 and downstream of the transfer corona discharger 27 with respect to rotational direction of the transfer drum. The cleaning means 28 includes a known cleaning blade. Reference numeral 24 depicts image exposure light. The separation pawl 29 is supported for pivotable movement in the direction indicated by an arrow in FIG. 2. It separates a transfer material P from the outer periphery of the transfer drum 26 after the transfer material P receives four color toner images by a transfer corona discharger 27 from the photosensitive drum 21 in alignment with each other. The separated transfer material P is conveyed into the fixing device.

Figure 5:
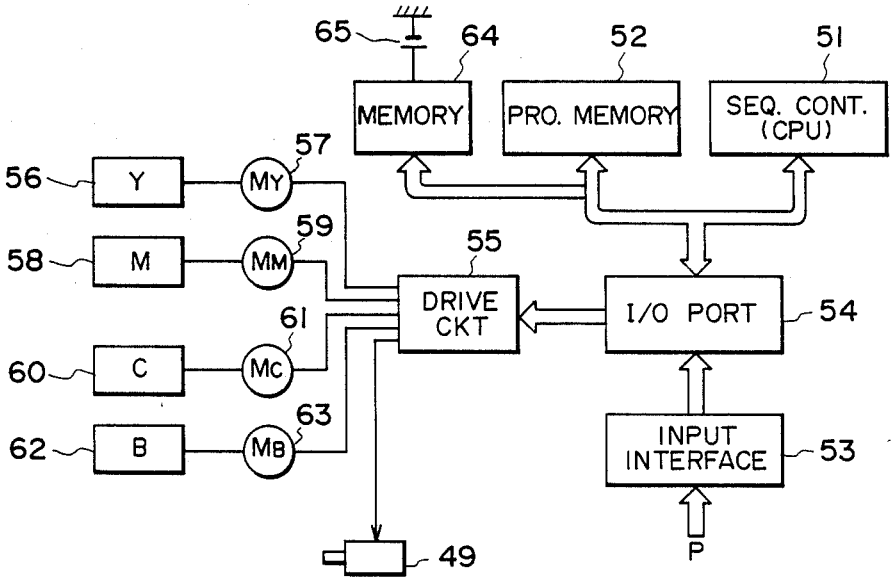
FIG. 5 is a block diagram of a processing and control system for a developer content control device provided in an image forming apparatus according to an embodiment of the present invention.

The toner content control device incorporated in the image forming apparatus includes a primary amplifier as shown in FIG. 8, a secondary amplifier as shown in FIG. 9 and an operational processing and control system as shown in FIG. 5. The control system is effective in this embodiment to perform the functions as described in conjunction with FIG. 11. Additionally, however, the control system is provided with a memory 64 and an initial state memorizing mode which corresponds to the memory 64 and in which in an initial operation using a reference developer, the toner detection signal and the reference light signal are stored in the memory 64.

The memory 64 is a non-volatile memory which is always backed up by a backup source 65 such as a battery. Until the memory is rewritten in the initial state memorizing mode programmed in the program memory 52, detection light signals and reference light signals for each color developers are stored. The memory 64 stores as detection light signals and reference light signals at the initial reference toner content, yellow toner content detection light signal P"2YO, yellow developer reference light signal P"1YO, magenta toner content detection light signal P"2MO, magenta developer reference light signal P"1MO, cyan toner content detection light signal P"2CO, cyan developer reference light signal P"1CO, black toner content detection light signal P"2BO, and black developer reference light signal P"1BO.

The reason for the provision of the memory 64 will be described. If there is no such a memory 64 as is always backed up by a backup source 65, the content of the memory stored is erased when the driving source of the apparatus is stopped, even if the signals are memorized each time the toner content is detected in the initial state memorizing mode. If the toner content varies each time the toner content detection is performed, the initial reference toner content level changes each time the toner content detection is effected, with the result that it becomes not possible to perform the toner content control with a predetermined toner content level.

In the above described structure, the output signals from the primary amplifier as shown in FIG. 8 and a secondary amplifier as shown in FIG. 9 are supplied to an input interface 53 of the operational processing and control system of the toner content control device as disclosed in FIG. 5. Further, they are stored in the program memory 52 at a predetermined address from the input interface 53 through the I/O port 54. Signals (P"1) on the basis of the reference light r and signals (P"2) on the basis of the detection light d stored in the program memory 52 at predetermined addresses, are

| | Detection light signal | Reference light signal |
|---|---|---|
| yellow developer | P"2Y | P"1Y |
| magenta developer | P"2M | P"1M |
| cyan developer | P"2C | P"1C |
| black developer | P"2B | P"1B |

The CPU 51 determines toner content signals for the respective color developers from the data stored in the program memory 52. More particularly, the yellow toner content signal D"Y, the magenta toner content signal D"M, the cyan toner content signal D"C and the black toner content signal D"B are determined by the following.

$$D''Y = P''2Y - P''1Y$$

$$D''M = P''2M - P''1M$$

$$D''C = P''2C - P''1C$$

$$D''B = P''2B - P''1C$$

The CPU 51 determines an initial reference toner content signal for each of the color developers from the data stored in the memory 64. Such signals for yellow, magenta, cyan and black developers D"YO, D"MO, D"CO and D"BO are calculated by $$D''YO = P''2YO - P''1YO$$

$$D''MO = P''2MO - P''1MO$$

$$D''CO = P''2CO - P''1CO$$

$$D''BO = P''2BO - P''1BO.$$

The CPU 51 compares the toner content signal of each color developers and the initial reference toner content signal associated. A yellow developer is taken as an example. If the result of comparison is $D''Y \geqq D''YO$, the CPU 51 deems that the yellow toner content is proper or higher, so that it does not instruct the toner supply to the yellow developing device 25Y. If, on the other hand, the result is $D''Y < D''YO$, it deems that the toner content is low. Then, the CPU 51 produces a drive instruction signal to the driving circuit 55, in response to which a hopper driving motor (MY) 57 associated with the hopper 56 containing the yellow toner is driven, so that the yellow toner is supplied into the yellow developing device 25Y from the hopper 56. The similar signal processing and toner supply, if necessary, are effected for the magenta, cyan and black developers. The magenta toner, the cyan toner and the black toner are supplied from the hopper 58 by the hopper driving motor (MM) 59, from the hopper 60 by the hopper driving motor (MC) 61 and from the hopper 62 and the hopper driving motor (MB) 63, respectively. The setting of the initial state memorizing mode is manually effected by actuating a mode starting switch.

In this embodiment, the toner content detecting device is of an optical type utilizing near infrared light. However, it is possible to use visible light, or another type of detecting system can be used. Also, the primary amplifier, the secondary amplifier, the operational processing and control system may have structures other than those disclosed herein. In addition, the number of colors are not limited to four, but two, three, five or more colors may be used with the present invention. Also, it is possible to apply the present invention to a monochromatic image forming apparatus. The developing device is not limited to the rotary type, but may be of a stationary type.

As described in the foregoing, according to this embodiment, the provision of the automatic toner content control system makes it possible to provide an image forming apparatus with the automatic control system of good operativeness.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

developing means for developing a latent image formed on said image bearing member, containing a two component developer containing toner and carrier and including a developer carrying member for carrying the developer toward said image bearing member;

a toner content detecting means including a reflecting member for receiving light and reflecting a quantity of light corresponding to a reference toner content, a light emitting element for applying light to the reflecting member and to the developer carrying member and a light receiving element for receiving the light reflected by the developer carried on said developer carrying member and the light reflected by the reflecting member to produce an electric signal in accordance with a quantity of light received thereby; and toner content control means for controlling toner supply to said developing means in accordance with a signal produced by said toner content detecting means;

said toner content control means including:

means for storing a ratio of a reference toner content signal from the light receiving element corresponding to a quantity of light from the developer at an initial reference toner content state to a reference reflection density signal from the light receiving element corresponding to a quantity of light reflected by said reflecting member, as an initial reference ratio signal; and toner supply control means for producing a ratio signal representative of a ratio of a toner content signal from the light receiving element corresponding to a quantity of light reflected by the developer upon toner content detection to a reflection density signal from said light receiving element corresponding to a quantity of light reflected by said reflecting member, and for comparing the ratio signals, and for controlling toner supply to said developing means on the basis of a result of the comparison.

2. An image forming apparatus, comprising:

an image bearing member;

developing means for developing a latent image formed on said image bearing member, containing a two component developer containing toner and carrier and including a developer carrying member for carrying the developer toward said image bearing member;

a toner content detecting means including a reflecting member for receiving light and reflecting a quantity of light corresponding to a reference toner content, a light emitting element for applying light to the reflecting member and to the developer carrying member and a light receiving element for receiving the light reflected by the developer carried on said developer carrying member and the light reflected by the reflecting member to produce an electric signal in accordance with a quantity of light received thereby;

toner content control means for controlling toner supply to said developing means in accordance with a signal produced by said toner content detecting means;

said toner content control means including:

means for storing a difference between a reference toner content signal from the light receiving element corresponding to a quantity of light from the developer at an initial reference toner content state and a reference reflection density signal from the light receiving element corresponding to a quantity of light reflected by said reflecting member, as an initial reference difference signal; and toner supply control means for producing a difference signal representative of a difference between a toner content signal from the light receiving element corresponding to a quantity of light reflected by the developer upon toner content detection and a reflection density signal from said light receiving element corresponding to a quantity of light reflected by said reflecting member, and for correcting the difference signal upon the toner content detection on the basis of the reference reflection density signal and a reflection signal upon the toner content detection, and for comparing the corrected signal and the initial reference difference signal, and for controlling toner supply to said developing means on the basis of a result of the comparison.

3. An image forming apparatus, comprising:

an image bearing member;

plural developing means containing two component developers, respectively, including different color toners and carriers, for developing latent images formed on said image bearing member with the developer;

toner content detecting means for detecting a toner content of each of the developers contained in the developing means; and toner content control means for controlling toner supply to each of said developing means in accordance with outputs of said toner content detecting means;

said toner content control means including:

plural amplifying sections, which correspond to said plural developing means, respectively, for amplifying detection signals indicative of the toner contents for the respective developers and for amplifying the detection signals indicative of the toner contents under initial reference toner content states, to signals having substantially the same level;

a memory section, responsive to said plural amplifying sections, for storing information relating to the respective toner contents under the initial reference toner content states; and a control section for controlling the toner supply to the respective developing means in accordance with the information stored in said memory section and in accordance with the detection signals which are detected after the information is stored in said memory section and which are amplified by said amplifying section.

4. An apparatus according to claim 3, wherein said toner content detecting means is provided with a detection optical system including light emitting means and a light receiving means for producing an output in accordance with a quantity of light received thereby, and wherein said light receiving means receives light reflected by the developer contained in each of said developing means illuminated by said light emitting means, and it produces on the basis of the reflected light an electric signal indicative of the toner content and a reference electric signal for correcting an error in the electric signal indicative of the toner content due to said detection optical system.

5. An apparatus according to claim 3, wherein said amplifying section is provided with a primary amplifying section for receiving the signals and amplifying them and a secondary amplifying section connected to an output side of said primary amplifier, and wherein said second amplifying section receives a reference toner content signal and reference signal from said light receiving means corresponding to a quantity of light reflected by the developer upon initial reference toner content state for each of the developers and amplifying it to provide respective outputs having substantially the same signal levels for the respective developers.

6. An image forming apparatus, comprising:

an image bearing member;

plural developing means containing two component developers, respectively, including different color toners and carriers, for developing latent images formed on said image bearing member with the developer;

toner content detecting means for detecting a toner content of each of the developers contained in the developing means; and toner content control means for controlling toner supply to each of said developing means in accordance with outputs of said toner content detecting means;

said toner content control means including:

plural amplifying sections, which correspond to said plural developing means, respectively, for amplifying detection signals indicative of the toner contents for the respective developers and for amplifying the detection signals indicative of the toner contents under initial reference toner content states, to signals having substantially the same level; and a control section for controlling the toner supply to the respective developing means in accordance with the detection signals which are detected and are amplified by said amplifying sections.

7. An apparatus according to claim 6, wherein said toner content detecting means is provided with a detection optical system including light emitting means and a light receiving means for producing an output in accordance with a quantity of light received thereby, and wherein said light receiving means receives light reflected by the developer contained in each of said developing means illuminated by said light emitting means, and it produces on the basis of the reflected light an electric signal indicative of the toner content and a reference electric signal for correcting an error in the electric signal indicative of the toner content due to said detection optical system.

8. An apparatus according to claim 6, wherein said amplifying section is provided with a primary amplifying section for receiving the signals and amplifying them and a secondary amplifying section connected to an output side of said primary amplifier, and wherein said second amplifying section receives a reference toner content signal and reference signal from said light receiving means corresponding to a quantity of light reflected by the developer upon initial reference toner content state for each of the developers and amplifying it to provide respective outputs having substantially the same signal levels for the respective developers.

9. An apparatus according to claim 6, wherein said control section controls the toner supply in accordance with a reference signal common to the respective developers and the respective signals amplified by said amplifying sections.

10. An image forming apparatus, comprising:

an image bearing member;

plural developing means containing developers, respectively, including different color toners and carriers, for developing latent images formed on said image bearing member with the developer;

toner content detecting means for detecting a toner content of each of the developers contained in the developing means, said toner content detecting means including a first section common to the plural developing means and plural second sections which are associated with the respective developing means, wherein the first section includes a light source and light receiving means for providing an electric signal corresponding to an amount of light received thereby, and each of the second sections includes a developer illuminating part, an illumination light path for directing light from the light source to the developer illuminating part, and a reflected light path for directing the light reflected by the developer at the illumination part to the light receiving means; and toner content control means for controlling toner supply to each of said developing means in accordance with outputs of said toner content detecting means;

said toner content control means including:

plural amplifying sections, which correspond to said plural developing means, respectively, for amplifying detection signals indicative of the toner contents for the respective developers and for amplifying the detection signals indicative of the toner contents under initial reference toner content states, to signals having substantially the same level;

a memory section, responsive to said plural amplifying sections, for storing information relating to the respective toner contents under the initial reference toner content states; and a control section for controlling the toner supply to the respective developing means in accordance with the information stored in said memory section and in accordance with the detection signals which are detected after the information is stored in said memory section and which are amplified by said amplifying section.

11. An image forming apparatus, comprising:

an image bearing member;

plural developing means containing developers, respectively, including different color toners and carriers, for developing latent images formed on said image bearing member with the developer;

toner content detecting means for detecting a toner content of each of the developers contained in the developing means, said toner content detecting means including a first section common to the plural developing means and plural second sections which are associated with the respective developing means, wherein the first section includes a light source and light receiving means for providing an electric signal corresponding to an amount of light received thereby, and each of the second sections includes a developer illuminating part, an illumination light path for directing light from the light source to the developer illuminating part, and a reflected light path for directing the light reflected by the developer at the illumination part to the light receiving means; and toner content control means for controlling toner supply to each of said developing means in accordance with outputs of said toner content detecting means;

said toner content control means including:

plural amplifying sections, which correspond to said plural developing means, respectively, for amplifying detection signals indicative of the toner contents for the respective developers and for amplifying the detection signals indicative of the toner contents under initial reference toner content states, to signals having substantially the same level; and a control section for controlling the toner supply to the respective developing means in accordance with the detection signals which are detected and are amplified by said amplifying sections.

12. An apparatus according to claim 11, wherein said control section controls the toner supply in accordance with a reference signal common to the respective developers and the respective signals amplified by said amplifying sections.

13. An image forming apparatus, comprising:

an image bearing member;

developing means for developing a latent image formed on said image bearing member, having a developer containing toner and carrier and including a developer carrying member for carrying the developer toward said image bearing member;

toner content detecting means including a light emitting member and a light receiving member for producing an electric signal in accordance with a quantity of light received thereby, wherein the light receiving member receives reference light from the light emitting member and the light reflected by the developer illuminated by the light emitting member;

means for storing a ratio of reference toner content signal from the light receiving member corresponding to a quantity of light from the developer at an initial reference toner content state to a reference signal from the light receiving member corresponding to a quantity of reference light from said light emitting member, as an initial reference ratio signal; and toner supply control means for producing a ratio signal representative of a ratio of a toner content signal from the light receiving member corresponding to a quantity of light from the developer upon toner content detection to a reference signal from said light receiving member corresponding to a quantity of reference light upon toner content detection, and for comparing the ratio signals, and for controlling toner supply to said developing means on the basis of a result of the comparison.

14. An image forming apparatus, comprising:

an image bearing member;

developing means for developing a latent image formed on said image bearing member, having a developer containing toner and carrier and including a developer carrying member for carrying the developer toward said image bearing member;

toner content detecting means including a light emitting member and a light receiving member for producing an electric signal in accordance with a quantity of light received thereby, wherein the light receiving member receives reference light from the light emitting member and the light reflected by the developer illuminated by the light emitting member;

means for storing a difference between a reference toner content signal from the light receiving member corresponding to a quantity of light from the developer at an initial reference toner content state and a first reference signal from the light receiving member corresponding to a quantity of reference light from said light emitting member, as an initial reference difference signal; and toner supply control means for producing a difference signal representative of a difference between a toner content signal from the light receiving member corresponding to a quantity of light from the developer upon toner content detection and a second reference signal from said light receiving member corresponding to a quantity of reference light upon toner content detection, and for correcting the difference signal upon the toner content detection on the basis of the first reference signal and the second reference signal, and for comparing the corrected signal and the initial reference difference signal, and for controlling toner supply to said developing means on the basis of a result of the comparison.

15. An image forming apparatus, comprising:

an image bearing member;

plural developing means containing developers, respectively, including different color toners and carriers, for developing latent images formed on said image bearing member with the developer;

toner content detecting means for detecting a toner content of each of the developers contained in the developing means; and toner content control means for controlling toner supply to each of said developing means in accordance with outputs of said toner content detecting means;

said toner content control means including:

a first amplifying section common to said plural developing means for amplifying the detection signals indicative of the toner contents of the developers;

plural second amplifying sections which correspond to the respective developing means for amplifying the signals from the first amplifying section to provide signals having substantially the same level; and a control section for controlling the toner supply to the respective developing means, using the signals which correspond to the respective developers and which are produced by the respective second amplifying section.

16. An apparatus according to claim 15, wherein the second amplifying sections have different amplification factors.

17. An apparatus according to claim 16, wherein said toner content detecting means includes a first section common to the plural developing means and plural second sections which are associated with the respective developing means, wherein the first section includes a light source and light receiving means for providing an electric signal corresponding to an amount of light received thereby, and each of the second sections includes a developer illuminating part, an illumination light path for directing light from the light source to the developer illuminating part, and a reflected light path for directing the light reflected by the developer at the illumination part to the light receiving means;

wherein an output signal from the light receiving means is applied to said first amplifying section.

* * * * *

UNITED STATES PATENT AND TRADEMARK OFFICE

CERTIFICATE OF CORRECTION

PATENT NO. : 4,883,019

DATED : November 28, 1989

INVENTOR(S) : TAKESHI MENJO, ET AL.

It is certified that error appears in the above-identified patent and that said Letters Patent is hereby corrected as shown below:

COLUMN 3

Line 33, "developer" should read --developers--.
Line 61, "omitted to" should read --omitted from--.

COLUMN 4

Line 25, "developer conveying stirring" should read --developer conveying and stirring--.
Line 54, "operates," should read --operated,--.

COLUMN 5

Line 23, "an" should read --a--.
Line 26, "converts it" should read --converts it to--.

COLUMN 8

Line 25, "unit" should read --units--.
Line 29, "FIG. 7, a" should read --FIG. 7, is a--.

COLUMN 9

Line 10, "direction" should read --detection--.
Line 43, "light 4" should read --light r--.
Line 56, "reference signal" should read --reference light r through the filter 47 it produces an electric signal--.

UNITED STATES PATENT AND TRADEMARK OFFICE

CERTIFICATE OF CORRECTION

PATENT NO. : 4,883,019

DATED : November 28, 1989

INVENTOR(S) : TAKESHI MENJO, ET AL.

It is certified that error appears in the above-identified patent and that said Letters Patent is hereby corrected as shown below:

COLUMN 11

Line 21, "large" should read --larger--.
Line 25, "is connected" should be deleted.
Line 34, "amplifier" should read --amplifiers--.

COLUMN 14

Line 56, "is" should read --these--.

Signed and Sealed this

Twenty-eighth Day of April, 1992

*Attest:*

HARRY F. MANBECK, JR.

*Attesting Officer*

*Commissioner of Patents and Trademarks*